United States Patent [19]

Rossi

[11] 4,135,887

[45] Jan. 23, 1979

[54] FLOW IMPROVERS FOR CRUDE AND RESIDUAL-CONTAINING FUEL OILS

[75] Inventor: Albert Rossi, Warren, N.J.

[73] Assignee: Exxon Research & Engineering Co., Florham Park, N.J.

[21] Appl. No.: 833,968

[22] Filed: Sep. 16, 1977

[51] Int. Cl.[2] ..... C10L 1/18

[52] U.S. Cl. ..... 44/62; 44/70

[58] Field of Search ..... 44/62, 70

[56] References Cited

U.S. PATENT DOCUMENTS 3,382,055 5/1968 Jacobson et al. ..... 44/62

3,776,247 12/1973 Choufoer et al. ..... 44/70

*Primary Examiner*—Winston A. Douglas

*Assistant Examiner*—Y. Harris-Smith

*Attorney, Agent, or Firm*—Roland A. Dexter; Frank T. Johmann

[57] ABSTRACT

Copolymers of a 1,2 epoxy alkane and a cyclic carboxylate compound of the class consisting of dicarboxylic acid anhydrides, preferably maleic anhydride or a hydrocarbyl substituted succinic anhydride and a beta lactone, said copolymers having $C_{10}$ to $C_{50}$, preferably $C_{20}$ to $C_{40}$, linear, pendant hydrocarbon chains are flow improvers in residual and crude oils.

8 Claims, No Drawings

FLOW IMPROVERS FOR CRUDE AND RESIDUAL-CONTAINING FUEL OILS

FIELD OF THE INVENTION

This invention relates to copolymers of 1,2 epoxy alkanes and cyclic carboxylate compounds as polymeric additives having long side (pendant) chains as flow improvers for petroleum fuel oils and crude oils.

BACKGROUND OF THE INVENTION

Polymers of 1,2 epoxy alkanes having 10 to 18 carbon atoms have been taught in U.S. Pat. No. 3,382,055 as pour depressants for middle distillates and light lube oil stocks.

A mixture of a polymer obtained from $C_{14}$–$C_{50}$ epoxy alkanes and a Friedel-Crafts condensation product of a halogenated paraffin with an aromatic hydrocarbon has been taught to be useful for dewaxing waxy lubricating oils.

The epoxidation products of $C_{12}$–$C_{24}$ unsaturated animal, vegetable or synthetic oils are treated with polybasic inorganic acids to provide materials said to be useful as pour point depressants and emulsifiers (Netherlands Pat. No. 264,325).

SUMMARY OF THE INVENTION

The present invention is based upon the discovery that about equimolar condensation polymers of 1,2 epoxy alkanes, for example, a $C_{22}$ 1,2 epoxy alkane, with a cyclic carboxylate compound of the class consisting of dicarboxylic acid anhydrides, preferably maleic anhydride or maleic anhydride reacted with a long chain olefin, and beta lactones, preferably hydroacrylic acid, are useful as pour depressants in residuals and crude oils. At least one of said 1,2 epoxy alkanes or said cyclic carboxylate compounds or both must have a long straight chain hydrocarbon group of from 10 to 50, preferably from 20 to 40 carbons. These flow improvers will usually have number average molecular weights ($\overline{M}_n$) in the range of 750 to 50,000, preferably 1,000 to 10,000.

The invention also includes an oil composition comprising a major amount of petroleum oil selected from the group consisting of residua-containing fuels boiling above 315° C., distillate fuels boiling above 315° C. and crude oils, said petroleum oil being improved in its Flow Point by at least a flow improving amount of an oilsoluble, substantially equimolar copolymer of a 1,2 epoxy alkane and a cyclic carboxylate compound of the class consisting of dicarboxylic acid anhydrides and beta lactones wherein said copolymer is characterized by straight chain, pendant alkyl groups of 10 to 50 preferbly 20 to 40 carbons.

1,2 EPOXY ALKANES

The epoxy alkanes used in preparing the aforesaid copolymeric additive are those having the generic formula:

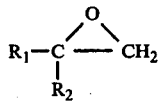

wherein $R_1$ is hydrogen or a linear alkyl group of 10 to 50, preferably 20 to 40, carbon atoms and $R_2$ is hydrogen or a lower alkyl group, e.g. a $C_1$-$C_4$ alkyl such as methyl, ethyl and butyl.

These 1,2 epoxy alkanes are selected from a wide group of compounds known and used in organic synthesis. The epoxy alkanes are prepared by means well known in the art, e.g., by reaction of an unsaturated aliphatic hydrocarbon, preferably having its double bond between the terminal carbon atoms of the chain, with hypochlorous acid, or an organic peroxide (e.g., m-chloroperbenzoic acid, trifluoroperacetic acid, etc.) to form an epoxide. In the reaction with hypochlorous acid, the chlorohydrin derivative is formd in the first step and is transformed to the epoxide by dehydrochlorination with an alkali such as sodium hydroxide. In each reaction, the result is the placement of a single oxygen atom across the double carbon atom bond. Specific examples of suitable epoxides include ethylene oxide, propylene oxide, 1,2-tetradecene oxide; 1,2-hexadecene oxide; 1,2-octadecene oxide; 1,2-eicosene oxide; 1,2-docosene oxide; 1,2-tetracosene oxide; 1,2-octacosene oxide; 1,2-triacotene oxide; and mixtures thereof.

CYCLIC CARBOXYLATE COMPOUNDS

These cyclic carboxylate compounds which are useful in preparing the aforesaid copolymeric additives are obtained from the class of dicarboxylic acid anhydrides and beta lactones. Either of these materials can be substituted with the $C_{10}$ to $C_{50}$, preferably $C_{20}$ to $C_{40}$, linear hydrocarbyl groups to provide the necessary pendant, linear hydrocarbon chains.

The dicarboxylic acid anhydride which may be substituted with said linear hydrocarbyl group is usefully an alpha-beta $C_4$–$C_{10}$ monounsaturated dicarboxylic acid anhydride represented by the structure

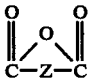

wherein Z is selected from alkylene and alkenylene and contains from 2 to 8 carbon atoms. Anhydrides of the following dicarboxylic acids are representative:

(a) where Z is an alkylene radical there is succinic acid and glutaric acid; and (b) where Z is an alkenylene radical there is maleic acid, glutaconic acid and itaconic acid.

Preferred is maleic anhydride and alkenyl succinic acid anhydrides which are readily obtained by the Ene reaction of an olefin with the alpha-beta unsaturated $C_4$–$C_{10}$ dicarboxylic acid anhydride such as itaconic anhydride, maleic anhydride, chloromaleic anhydride, etc. This Ene reaction is well known in the art and has been described in various patents such as U.S. Pat. No. 2,568,876. The most preferred alkenyl succinic anhydrides used in this invention are those in which the alkenyl group contains a total of from 10 to 50, preferably 20 to 40, carbon atoms.

Many of these hydrocarbyl substituted dicarboxylic acid anhydrides are commercially available, e.g. 2-octadecenyl succinic anhydride and polyisobutenyl succinic anhydride.

With 2-chloromaleic anhydride and related acylating agents, alkenyl chloromaleic anhydride reactants are formed.

The beta lactones can be characterized by the general formula

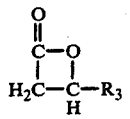

where $R_3$ is hydrogen or an alkyl group containing from 1 to 50 carbons, preferably from 20 to 40 carbons. Representative beta lactones include hydroacrylic acid, β-docosanolactone, β-octacosanolactone, etc. These compounds are well known in the literature and generally prepared by reacting a 3-chloroalkanoic acid, e.g. 3-chloropropionic acid and aqueous alkali. The 3-chloroalkanoic acid is readily obtained by reacting a 2,3 alkenoic acid, e.g. acrylic acid with HCl.

PREPARATION OF COPOLYMERS

The condensation polymerization of the 1,2 epoxy alkanes with the cyclic carboxylate compound is achieved by Lewis Base or Acid catalysis. The condensation polymerization is usually carried out in a solvent, usually about 2 to 10, e.g. 4 to 8 parts of hydrocarbon solvent, based on 1 part by weight of reactants, such as benzene, hexane, cyclohexane, etc., by dissolving the 1,2 epoxy alkane and cyclic carboxylate compound in the solvent, adding about 0.5 to 1.5 wt.%, based on the weight of reactants, of a Lewis Base or Acid polymerization catalyst, and then heating the mixture for about 0.5 to 10, preferably for about 1 to 5 hours at temperatures of about 50 to 100, preferably 60 to 80, 80° C. At the end of this time the solvent can be simply evaporated off to leave the condensation product. Alternatively, the condensation reaction can be simply carrid out in a nonvolatile light mineral lubricating oil. In this case, there is no need to recover the product from the solvent.

In preparing the condensation copolymer, approximately equimolar quantities of the 1,2 epoxy alkane and the cyclic carboxylate compound, e.g. alkenyl succinic anhydride are used. An example of a condensation catalyst that can be used is triethylamine.

THE PETROLEUM OILS

The oils which can be treated with the polymeric additives according to the invention include straight residuum from the atmospheric distillation of crude oil or shale oil or mixtures thereof. Residua and crude oils are very complex mixtures of paraffin wax, microcrystalline wax, asphalts, asphaltenes, resin, bitumens, etc. Residuum containing fuel will usually contain from about 5 to 100 percent, e.g. from about 35 percent to 100 percent by weight, of straight residuum which preferably boils above 315° C. or more usually above 350° C. at atmospheric pressure. The residuum containing fuels can also be blends of residuum and distillate oils. The distillate oil, in turn, can be a middle distillate fuel oil usually boiling in the 150 to 375° C. range or a vacuum or flash-distillate oil usually boiling in the 350° to 595° C. range at atmospheric pressure.

Vacuum or flash-distillates are those distillate fuels obtained by vacuum distillation at reduced pressure of the residue obtained from the distillation of crude oil at atmospheric pressure. Such fuels are prepared by distilling under atmospheric pressure, a crude oil to a bottom temperature of approximately 350° C. or higher, thereby obtaining an atmospheric residua which is then divided by flashing under greatly reduced pressure, into a flashed distillate and a vacuum residue. The temperature at which flashing is conducted is limited by potential cracking and carbonization, i.e. about 430° C. Flashing is usually conducted at greatly reduced pressure, in order to secure high distillate yield from a given atmospheric residue.

Shale oils per se may also be treated with the polymer blends of the invention, as may the crude oils themselves.

Some residuums, i.e., residual oils, have extremely high pour points of from 20° to 45° C., particularly those obtained from North African crudes, e.g. Libya, due to a high wax content. These oils also have low sulfur contents which make them particularly desirable because of air pollution requirements. These oils can be particularly improved by additives. Usually oils having 2 to 25 wt. percent wax boiling above about 345° C. will give the best response to the additives of the invention, while oils with lesser amounts of wax normally do not prevent flow problems. A few straight residuums have so much wax that in the unblended state they would require uneconomical additive treats or give only small improvements. These oils are best handled, usually by blending with a lower wax content oil, e.g. a distillate or another residuum, so as to reduce the total high boiling wax content to a point where the additive achieves a relatively large effect with a small amount of copolymeric additive.

The copolymeric additive blends of the invention can be used in combination with still other additives, e.g. rust inhibitors, antioxidants, sludge dispersants, etc.

The invention will be further understood by reference to the following examples which includes a preferred embodiment of the invention.

EXAMPLE 1

The following specific copolymers were used:

COPOLYMER A

This is a condensation copolymer of about equimolar proportions of a $C_{30+}$ alkenyl succinic anhydride and a $C_{22}$ alkylene oxide. This copolymer was prepared by adding 10..0 gms. (0.030 moles) of $C_{22}$ 1,2 epoxy alkane purchased as $C_{22}$ alpha olefin oxide from Viking Chemical Co. of Minneapolis, Minnesota, 12.0 gms. (0.023 mole) of $C_{30+}$ alkenyl succinic anhydride and 100 ml. of hexane to a 500 ml., 4-necked flask having a stirrer, thermometer and charging funnel. The reactant mixture was heated to 70–75° C. at which time 3 drops of triethylamine was added with stirring. The mixture was heated thereafter for about 3.5 hours at 70° C.

26.0 gms. of the crude product was dialyzed for 9 hours with boiling hexane solvent at 70° C. in a Soxhlet extraction device, using a semi-permeable rubber membrane, to remove low mol. wt. components, e.g. the hexane, unreacted monomers etc. 9.4 gms. of residue, representing a 43% yield of the copolymer, was obtained having a ($\overline{M}_n$) of 1230 by Vapor Phase Osmometry (VPO).

The $C_{30+}$ alkenyl succinic anhydride was prepared by reacting maleic anhydride by an "Ene" reaction with a $C_{30+}$ olefin fraction mixture having an ($\overline{M}_n$) of about 450 prepared by polymerization of ethylene in a growth reaction using an organic metalic catalyst.

An analysis of a sample of the $C_{30+}$ olefins showed a carbon distribution on a weight basis as follows: $C_{22}$—0.72 percent; $C_{24}$—2.18 percent; $C_{26}$—6.37 percent; $C_{28}$—12.96 percent; $C_{30}$—15.65 percent;

$C_{32}$—14.0 percent; $C_{34}$—11.37 percent; $C_{36}$—8.57 percent; $C_{38}$—7.05 percent; $C_{40}$—6.05 percent; $C_{42}$—4.3 percent; $C_{44}$—3.73 percent; $C_{46}$—3.45 percent; $C_{48}$—2.24 percent and $C_{50}$—1.38 percent.

Analysis of this $C_{30+}$ fraction also shows a total olefin content of about 90 wt. percent and about 10 wt. percent non-olefinic, e.g. paraffinic. The 90 wt. percent olefin portion was about 50 wt. percent of linear alpha olefin, about 25 wt. percent of cis-trans olefins of the formula R—CH=CH-R and about 15 wt. percent of 1,1 dialkyl olefin of the structure

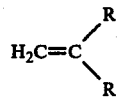

wherein each of said R groups represent alkyl groups of varying lengths. Further copolymers B throgh G were prepared according to the above procedure with reactants varied in nature and amount as shown in the following Table I.

TABLE I

| Copolymer | Co-Monomers: 1,2 Epoxy Alkane[1] Type | Moles Reacted | Cyclic Carboxylate Material Type | Moles Reacted | Yield % | Copolymer Mn (VPO) |
|---|---|---|---|---|---|---|
| A | $C_{22}$ | 0.030 | $C_{30+}$ ASA* | 0.023 | 43 | 1230 |
| B | $C_{22}$ | 0.030 | $C_{22-28}$ ASA** | 0.027 | 31 | — |
| C | $C_{22-28}$ | 0.043 | Hydroacrylic acid | 0.050 | 12 | 2190 |
| D | $C_{11-14}$ | 0.025 | $C_{30+}$ ASA* | 0.030 | 53 | 1070 |
| E | $C_{15-18}$ | 0.025 | $C_{30+}$ ASA* | 0.030 | 42 | 1250 |
| F | $C_{22-28}$ | 0.030 | $C_{30+}$ ASA* | 0.023 | 28 | 1050 |
| G | $C_{22-28}$ | 0.030 | $C_{30+}$ ASA* + PIBSA*** | 0.023<br>0.001 | 14 | 1450 |

[1]All 1,2 epoxy alkanes purchased from Viking Chemical Co. of Minneapolis, Minn. with the $C_{22}$ sold as $C_{22}$ alpha olefin oxide, the $C_{22-28}$ sold as $C_{22-28}$ olefin oxides, the $C_{11-14}$ sold as $C_{11-14}$ Neodox and the $C_{15-18}$ sold as $C_{15-18}$ Neodox (the designation $C_{22}$ is believed to indicate a $C_{22}$ 1,2 epoxy alkane, the designation $C_{22-28}$ is believed to indicate 1,2 epoxy alkanes of 22 to 28 carbons, the designation $C_{11-14}$ is believed to indicate 1,2 epoxy alkanes of 11 to 14 carbons, and the designation $C_{15-18}$ is believed to indicate 1,2 epoxy alkanes of 15 to 18 carbons).
*ASA represents alkenyl succinic anhydride described in Example 1.
**The alkenyl group of this alkenyl succinic anhydride has a carbon distribution of 22 to 28 carbons.
***PIBSA represents polyisobutenyl succinic anhydride having a (Mn) of about 1080.

EXAMPLE 2

Blends of the above copolymers in a Racoon Bend crude oil and a waxy Brega residua oil were prepared by simply heating and stirring the oil and copolymer up to about 54° C and 82° C, respectively, to dissolve the copolymer into the oil. The Brega residua oil was obtained by atmospheric distillation to a final vapor temperature of about 345° C of a crude oil from Libya which is a mixture of about 85 wt. % of crude from the Zelten Field with the remainder being from the Sarir and Dakar fields. This Brega residua is a very waxy black oil having about 8 to 13 wt. % wax boiling above 345° C and having ASTM D-97-66 upper and lower pour point of 41° C, and an initial atmospheric boiling point of 345° C F.V.T. (Final Vapor Temperature, i.e. F.V.T.). The Racoon Bend crude oil is an Austin County, Texas petroleum crude having an ASTM D-97-66 upper and lower pour point of 21° C, a viscosity of 43 SUS at 38° C and an API gravity of 31.8.

The blends of oil and copolymer additive were tested for pour point depression since this is a measure of the ability of the copolymeric additive to keep the wax in suspension, thereby eliminating or reducing the amount of the wax which will deposit upon flow surfaces exposed to the oil, while improving the Flow Point of the oil.

The copolymer additive is as noted, blended into the petroleum oil in at least an amount sufficient to improve the Flow Point. Such a blending will most usually be in the amount of from about 0.0005 to 0.8, preferably from about 0.001 to about 0.4, optimally about 0.03 to 0.3 wt. % of copolymer additive, said wt. % being based on the total weight of the oil composition.

The results, according to the invention, are given in the following Table II, wherein the upper and lower pour points were determined according to ASTM procedure D-97-66.

TABLE II

| Example | Copolymeric Additive | Racoon Bend Crude Oil: Wt.% Additive | Upper Pour Point ° C | Lower Pour Point ° C | Brega Residua Oil: Wt.% Additive | Upper Pour Point ° C | Lower Pour Point ° C |
|---|---|---|---|---|---|---|---|
| 1 | A | 0.05 | −37 | −23 | 0.3 | 10 | 13 |
| 2 | B | 0.05 | −26 | −21 | 0.3 | 32 | 21 |
| 3 | C | 0.05 | 10 | −7 | 0.15 | 38 | 18 |
| 4 | D | 0.05 | 7 | 7 | — | — | — |
| 5 | E | 0.05 | 7 | 4 | — | — | — |
| 6 | F | 0.05 | 16 | −1 | — | — | — |
| 7 | G | 0.05 | −7 | −1 | — | — | — |
| 8 | No additive | — | 21 | 21 | — | 41 | 41 |
| 9 | Copolymer of U.S. 3,790,358[1] | | | | 0.15 | 21 | 13 |
| 10 | Copolymer of U.S. 3,926,579[2] | 0.15 | −21 | −37 | | | |

[1]Copolymer prepared from 67 wt.% docosene-1 and 33 wt.% butene with ($\overline{M}_n$) of 3350 as shown in Table III of U.S. 3,790,358, col.7, line 53.
[2]Copolymer prepared from 40 wt.% docosene-1 and 60 wt.% hexene-1 with ($\overline{M}_n$) of 5530 as shown in Table of U.S. 3,926,579, col.6, line 14; however, note that the crude in which it was blended had an upper pour point of 24° C and lower pour point of 2° C.

It can be seen from the above data that the copolymeric additives of the invention markedly improve the Flow Point of both crude and residua oils, e.g. copolymer additive A lowers the upper point 58° C and the lower pour point 44° C of a crude oil, whereas a prior copolymeric additive at three times the concentration reduces upper and lower pour points 45° C and 39° C, respectively. At these levels, the higher the concentration of additive, a greater decrease would be expected; however, a greater weight potency is realized according to this invention. In residua-oils an advantage is shown over prior art additives when the invention disclosed herein is used, e.g. copolymeric additive A at 0.3 wt. % concentration is clearly superior to the copolymer of U.S. Pat. No. 3,790,358 when the latter is used at 0.15 wt. % in Brega Residua Oil.

For ease in handling, the copolymeric additive of the invention may be utilized in concentrate form. For example, to facilitate storage and transportation, the copolymer may be blended with a hydrocarbon solvent such as mineral oil to form a concentrate comprising from about 20 to 90 wt.% hydrocarbon solvent and from about 10 to about 80 wt.% of the copolymer of the invention.

By substantially equimolar as used herein, the molar ratio of 1,2 epoxy alkane to cyclic carboxylate material can range from 1:2 to 2:1, and preferably from about 1:1.5 to 1.5:1.

The invention in its broader aspect is not limited to the specific details shown and described and departures may be made from such details without departing from the principles of the invention and without sacrificing its chief advantages.

What is claimed is:

1. An oil composition comprising a major amount of petroleum oil selected from the group consisting of residua-containing fuels boiling above 315° C. and comprising about 5 to 100% by weight of residua, distillate fuels boiling above 315° C. and crude oils, said petroleum oil being improved in its Flow Point by at least a flow improving amount of an oil-soluble, flow improving substantially equimolar condensation copolymer of a 1,2 epoxy alkane having a linear alkyl group of 10 to 50 carbon atoms, and a cyclic carboxylate compound selected from the group consisting of alpha-beta $C_4$–$C_{10}$ monounsaturated dicarboxylic acid anhydrides, said acid anhydrides substituted with a linear $C_{10}$–$C_{50}$ hydrocarbyl group, and beta lactones of the general formula:

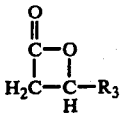

wherein $R_3$ is selected from the group consisting of hydrogen and $C_1$–$C_{50}$ alkyl groups, wherein said condensation copolymer is characterized by straight chain, pendant alkyl groups of 10 to 50 carbons and a number average molecular weight in the range of about 750 to 50,000.

2. An oil composition according to claim 1 wherein said flow improving amount ranges from about 0.001 to 0.5 weight % based on the total weight of said composition and the number average molecular weight of said copolymer ranges from about 1000 to 10,000.

3. An oil composition according to claim 2 wherein said oil is a residua-containing fuel and said copolymer is of a 1,2 epoxy alkane having about 22 carbons and a $C_{22}$–$C_{28}$ alkenyl succinic anhydride.

4. An oil composition according to claim 2 wherein said oil is a crude oil and said copolymer is of a $C_{22}$–$C_{28}$ 1,2 epoxy alkane and an alkenyl succinic anhydride, wherein said alkenyl group contains from 22 to 50 carbons.

5. An oil composition according to claim 2 wherein said oil is a crude oil and said copolymer is of a $C_{22}$–$C_{28}$ 1,2 epoxy alkane and hydroacrylic acid.

6. An oil composition according to claim 2 wherein said oil is a resiuda-containing fuel and said copolymer is of a 1,2 epoxy alkane having about 22 carbons and an alkenyl succinic anhydride wherein said alkenyl group contains from 22 to 50 carbons.

7. An oil composition according to claim 1, wherein a major proportion of said alkyl groups of 10 to 50 carbon atoms is the range of 20 to 40 carbon atoms.

8. An oil composition according to claim 7, wherein said condensation product consists essentially of copolymer of: (a) 1,2 epoxy alkane having a linear alkyl group of 20 to 40 carbon atoms, and (b) alkenyl succinic anhydride, wherein said alkenyl group defines a straight chain $C_{20}$ to $C_{40}$ alkyl group.

* * * * *